United States Patent [19]

Liddell

[11] 4,058,985

[45] Nov. 22, 1977

[54] PROTECTION OF METALLIC STRUCTURAL ELEMENTS AGAINST CORROSION

[76] Inventor: Orval E. Liddell, 333 Descanso Ave., Avalon, Calif. 90704

[21] Appl. No.: 706,741

[22] Filed: July 19, 1976

[51] Int. Cl.[2] ..... E02D 5/60

[52] U.S. Cl. ..... 61/54; 52/170

[58] Field of Search ..... 61/54, 39, 35; 52/169, 52/170, 514, 623, 729; 264/32, 36

[56] References Cited

U.S. PATENT DOCUMENTS

| | | | |
|---|---|---|---|
| 3,027,610 | 4/1962 | Liddell | 61/54 X |
| 3,321,924 | 5/1967 | Liddell | 61/54 |
| 3,352,118 | 11/1967 | Burkhardt | 61/54 X |
| 3,524,231 | 8/1970 | Wiswell | 61/54 X |
| 3,720,068 | 3/1973 | De Rosa | 61/54 X |
| 3,890,795 | 6/1975 | Maurer | 61/54 |
| 3,939,665 | 2/1976 | Gosse et al. | 61/54 |

*Primary Examiner*—Dennis L. Taylor

*Attorney, Agent, or Firm*—Fulwider, Patton, Rieber, Lee & Utecht

[57] ABSTRACT

Apparatus for protecting a partially or fully submerged metallic structural element of irregular cross-section against corrosion from water, air or a combination of both. Filler blocks are secured to the irregular structural element to provide a uniform cross-section, and a pliable watertight and airtight encasement is wrapped around the portion of the element to be protected. Seal means are utilized to seal the edges of the encasement against water and air.

2 Claims, 15 Drawing Figures

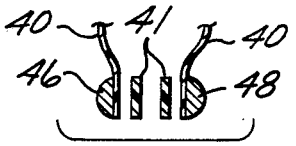
FIG. 8
FIG. 9
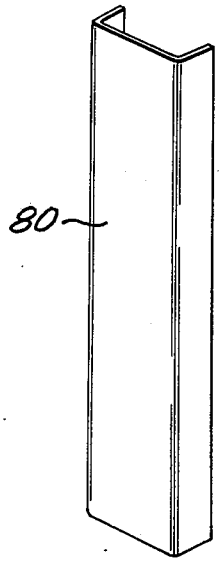
FIG. 10
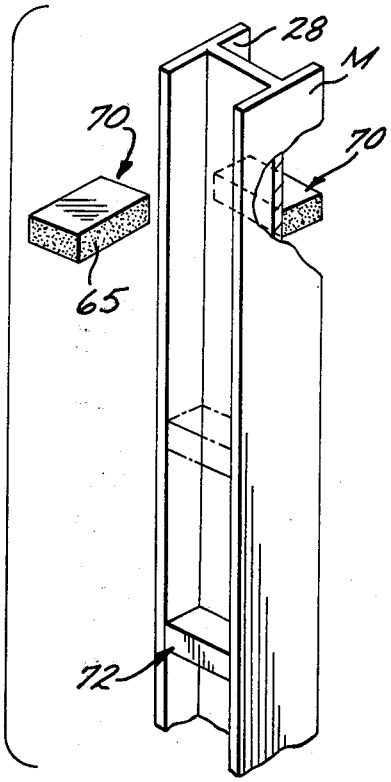
FIG. 11
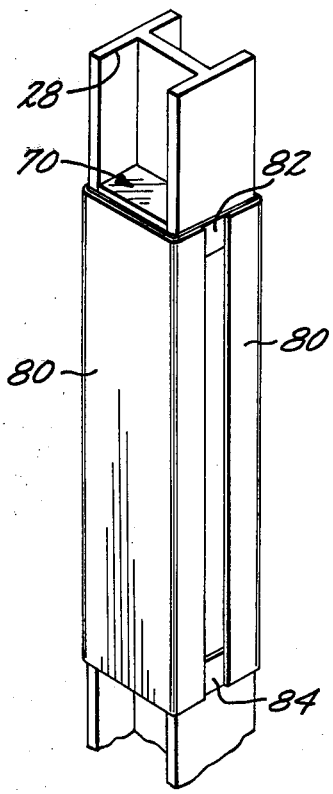
FIG. 12
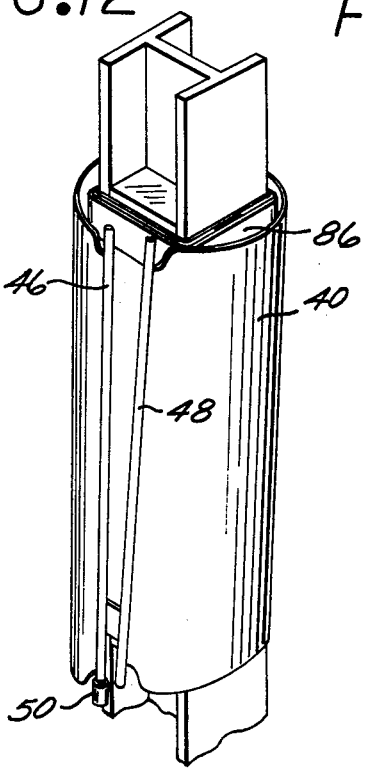
FIG. 13
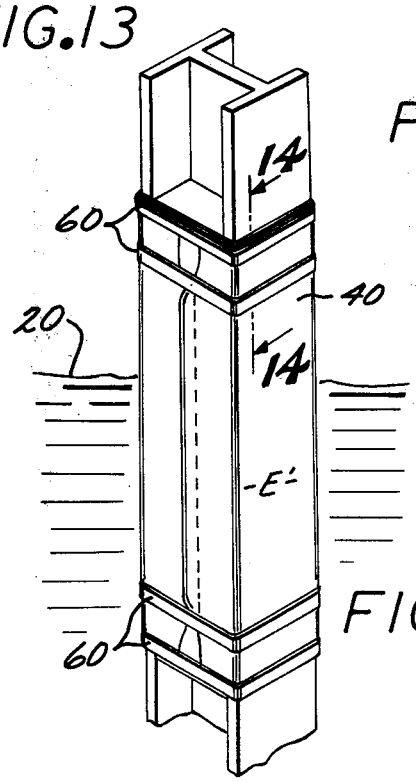
FIG. 14
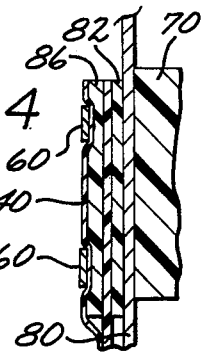
FIG. 15
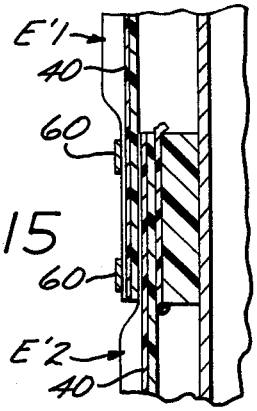

PROTECTION OF METALLIC STRUCTURAL ELEMENTS AGAINST CORROSION

BACKGROUND OF THE INVENTION

1. Field of the Invention

The present invention relates to apparatus for protecting a partially or fully submerged metallic structural element against corrosion from air, water or a combination of both.

2. Description of the Prior Art

It is common to protect the submerged portion of a metallic structural element from corrosion by cathodic methods. Such cathodic protection is expensive and only protects the submerged portion of the metallic element and not the portion thereof in the splash zone. Corrosion protection has also been provided for both the submerged and air-exposed portions of such metallic elements by means of noncorrosive coatings. When such coatings fail, however, they cannot readily be replaced on the submerged portion of the metallic element, and it is expensive to replace such coatings on the splash zone portion of such element. It has also been proposed to add concrete sleeves around such metallic elements. This process is quite expensive, and additionally, such concrete sleeves are difficult to install. For sections of metallic elements above water and exposed to air and mixture, the usual practice has been to apply noncorrosive coatings, such as paints, metallic coatings, epoxies and the like to protect against corrosion. These methods have been expensive and the service life is limited.

SUMMARY OF THE INVENTION

The apparatus of the present invention is characterized by a pliable, watertight and airtight encasement which is installed about the length of a metallic structural element having an irregular horizontal cross section to protect such structural element from water and air corrosion. The encasement includes filler block assemblies secured to vertically spaced portions of the structural element to fill the cavities thereof and provide a uniform horizontal cross-section. Backup sheet means encircle the structural element in abutment with the filler block assemblies and cover the edges of the structural element. The back-up sheet means are encircled by a pliable water and airtight encasement sheet. Foam bands are interposed between the top and bottom of the back-up sheet means and the encasement sheet. Wrapping bands are then extended around the upper and lower portions of the encasement sheet to compress the sealing bands into a water and airtight sealing relationship with the upper and lower ends of the encasement sheet. The vertical edges of the sheet are also sealed.

For the installation of the pliable watertight and airtight encasement, any existing surface corrosion deposits will not be removed, since such corrosion coating provides an initial surface protection of the base metal surface. Normally such deposits cause roughening of the steel structural elements. The filler blocks and back-up sheet means prevent abrading contact between the encasement sheet and such roughened elements.

Advantages of this invention include the use of proven, long-life materials of proven corrosion resistance, no surface cleaning is required, the installation can be made in-place on any metallic element, whether above water, at the splash zone or completely below water without any interference with operations of the structure, the installation is very simple and easy to apply, the cost is far below other present corrosion protective methods and the service life will greatly exceed that now being realized with other methods. It is estimated that this design of encasement will provide a service life of over 30 years.

Other advantages of the present invention will become apparent from the following detailed description, when taken in conjunction with the appended drawings.

BRIEF DESCRIPTION OF THE DRAWINGS

FIG. 8 is a broken top plan view of the pole pieces used with the apparatus of FIGS. 1 through 7;

FIG. 9 is a perspective view showing a back-up sheet of channel shape utilized with a second form of apparatus embodying the present invention;

FIG. 10 is a perspective view of a structural element to which is applied a second form of filler blocks utilized with such second form of apparatus;

FIG. 11 is a perspective view showing the aforementioned back-up channel and filler blocks in place on the structural element;

FIG. 12 is a perspective view showing an encasement sheet being applied to the structural element of FIGS. 10 and 11;

FIG. 13 is a perspective view showing the completed apparatus embodying the present invention;

FIG. 14 is a vertical sectional view taken in enlarged scale along line 14—14 of FIG. 13; and FIG. 15 is a broken side elevational view in enlarged scale showing a seal between two modular units embodying the present invention.

DESCRIPTION OF THE PREFERRED EMBODIMENTS

Figure 1:
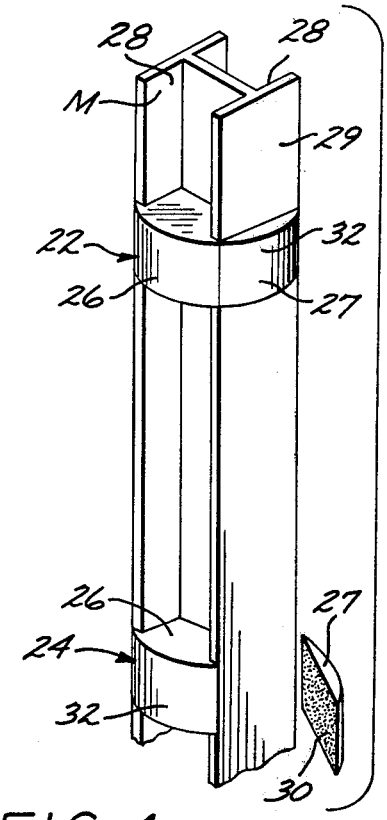
FIG. 1 is a perspective view of a metallic structural element to which is applied filler blocks in accordance with a preferred embodiment of the present invention.

Referring to the drawings, and particularly FIGS. 1–8 thereof, there is shown a metallic structural element M having a noncontinuous, transverse cross sectional configuration, i.e., such element is of generally H-shaped configuration. The structural element M may be a steel piling and is shown partially submerged in sea water to a level indicated at 20. A water and airtight encasement E is applied to a submerged portion of element M and the splash zone portion of such structural elememt immediately above the submerged portion.

More particularly, and referring now to FIG. 1, top and bottom filler block assemblies 22 and 24 are affixed to vertically spaced portions of structural element M.

Preferably, each filler block assembly will be fabricated of two like pairs of blocks 26 and 27 molded from a suitable rigid synthetic, closed cell plastic foam, although other materials, such as wood or metal, could be employed. The pair of blocks 26 fill the opposing cavities 28 of structural element M, while the pair of blocks 27 cover the sides 29 of such element. To facilitate attachment of the filler blocks to the structural element M, the edge surfaces of such filler blocks may receive a coating of a suitable water and airtight adhesive, designated 30, to permit such blocks to be manually affixed in place to the partially submerged structural element M. With continued reference to FIG. 1, it will be noted that the size and configuration of the filler blocks 26 and 27 are so chosen that their exterior surfaces 32 cooperatively define a cylindrical surface.

Figure 2:
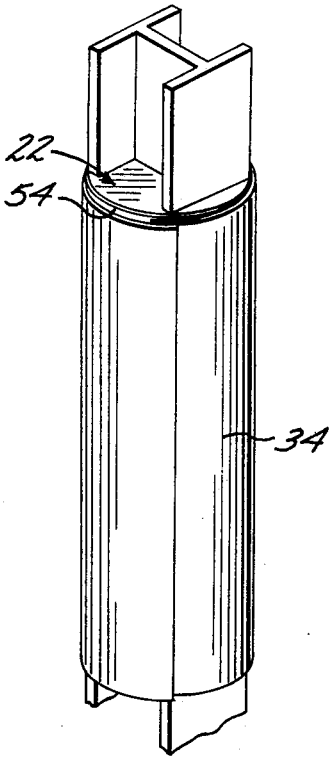
FIG. 2 is a perspective view showing a first form of back-up sheet means wrapped about the filler blocks of FIG. 1.

Referring now to FIG. 2, back-up sheet means in the form of split cylinder 34 is positioned around the structural element M with its upper and lower inner surfaces abutting the exterior surfaces 32 of the aforementioned filler blocks 26 and 27. Preferably, the back-up cylinder 34 will be formed of a synthetic plastic sheet material, such as polyvinyl chloride, formulated so as to have a relaxed diameter less than the diameter defined by the outer surfaces 32 of the filler blocks. Such back-up cylinder 34 may be applied about the filler blocks by a diver, such diver expanding the cylinder over the filler blocks, with the cylinder thereafter automatically snapping radially inwardly into its final position abutting the exterior surfaces 32 of the filler blocks. Back-up cylinder 34 may also be formed of a suitable metal or plywood. Preferably, the backup cylinder 34 will be affixed in place by suitable fastening means (not shown), such as nails driven through the cylinder into the filler blocks and/or the structural element M.

Figure 3:
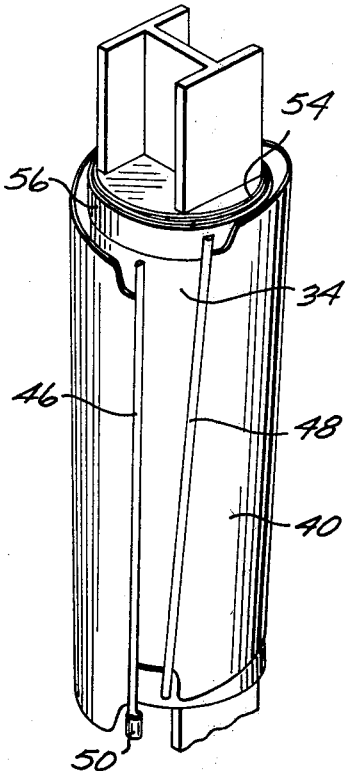
FIG. 3 is a perspective view showing an encasement sheet being positioned about the back-up sheet means of FIG. 2.

Referring now to FIG. 3, a substantially rectangular sheet 40 of synthetic plastic material is wrapped about the back-up cylinder 34. A suitable synthetic plastic material is polyvinyl chloride. Other similar materials, however, will prove satisfactory so long as such materials are water and airtight. The sheet 40 has a width throughout its length exceeding the corresponding circumference of the back-up cylinder 34. The vertical edges of the encasement sheet 40 are stiffened or rigidly reinforced against bending by a pair of vertically extending pole pieces 46 and 48. Both of the pole pieces 46 and 48 are semicylindrical and are formed of wood, metal, synthetic plastic or the like. The flat side of each pole piece is rigidly affixed as by stapling or cement to its respective edge of the encasement sheet 40. The pole pieces 46 and 48 permit the sheet to be readily manipulated for placement around the back-up cylinder 34. Along the flat sides of pole pieces 46 and 48 are attached strips 41 of polyurethane foam, polyether foam, neoprene foam, mastic or any other suitable material (not shown), that, when compressed, will form a waterproof and air proof longitudinal seal. (See FIG. 8) With the encasement sheet 40 partially wrapped around the back-up cylinder 34 and structural element M in the manner shown in FIG. 3, the lower ends of the pole pieces 46 and 48 are releasably joined by means of a lower socket 50 secured to the lower end of one of the pole pieces 46. Thereafter, the lower end of the other pole piece 48 is inserted in the socket 50 in a nonrotational manner. Next, the two pole pieces are brought together to define a substantially cylindrical unit.

Figure 4:
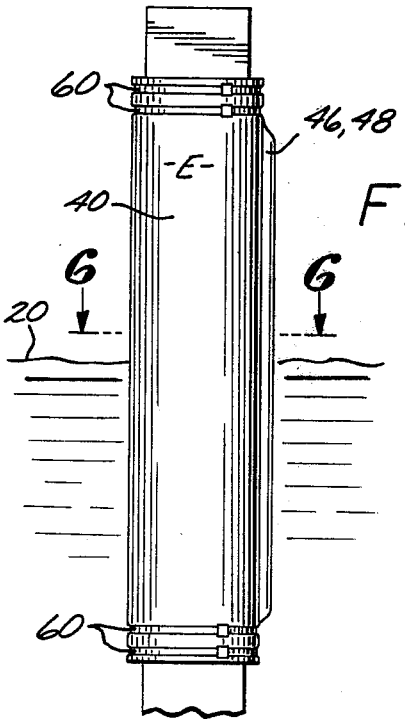
FIG. 4 is a side elevational view of the completed apparatus of FIG. 5.
Figure 5:
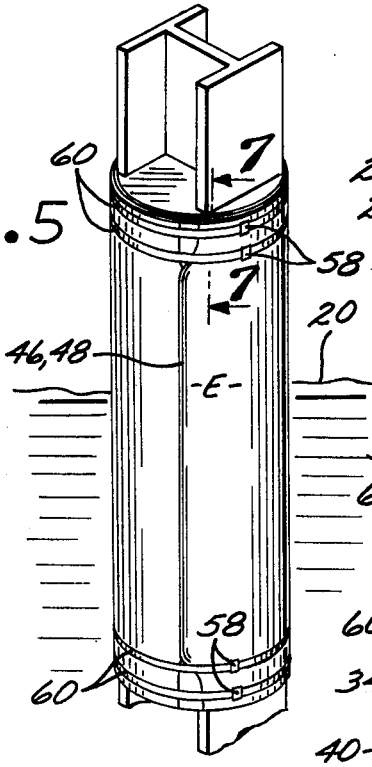
FIG. 5 is a perspective view showing a completed apparatus utilizing a preferred embodiment of the present invention.
Figure 6:
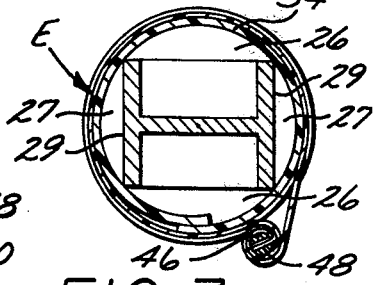
FIG. 6 is a horizontal sectional view taken along line 6—6 of FIG. 4.

Referring now to FIGS. 4, 5 and 6, the joined together pole pieces may then be tightened by means of wrenches (not shown), such wrenches rotating the pole pieces about their vertical axes. During this tightening operation, the foam strips 41 attached to the flat sides of the pole pieces will be compressed to form a longitudinal waterproof and air proof seal against the entry of corrosive media. A more detailed description of the manner in which the pole pieces are rotated to tighten the encasement sheet 40 is set forth in my copending patent application, Ser. No. 490,316, filed July 22, 1974, now U.S. Pat. No. 3,996,757. It will be apparent that the length of the pole pieces are less than that of the encasement sheet 40.

Figure 7:
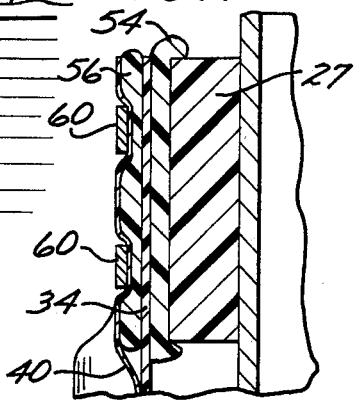
FIG. 7 is a vertical sectional view taken in enlarged scale along line 7—7 of FIG. 5.

Referring now particularly to FIGS. 3 and 7, it is important to note that upper and lower interior sealing bands 54 are interposed between the outer surfaces 32 of the filler blocks 26 and the adjacent interior surface of the back-up cylinder 34. Exterior upper and lower sealing bands 56 of like construction are interposed between the exterior upper and lower surfaces of the back-up cylinder 34 and the interior upper and lower surfaces of the encasement sheet 40. Such sealing bands are preferably formed of a material having physical characteristics such that it will have a memory and may be compressed to a fraction of its unconfined volume and thereafter it will exert pressure in its attempt to regain its original uncompressed shape. Suitable materials are polyurethane foam, polyether foam, neoprene foam, or other readily compressible materials with high resilience and with a memory such that the bands will continually exert a sealing pressure while compressed.

A pair of upper and lower wrapping bands 60 of like construction are secured around the upper and lower portions of encasement sheet 40 exteriorly of filler block assemblies 22 and 24. Conveniently, these bands will take the form of a noncorrosive synthetic plastic or metallic strap which is tightened about of a suitable hand tool (not shown) and the ends of such bands are thereafter rigidly secured together, as by means of a conventional clamp or clip 58. It will be apparent, however, that other sealing arrangements may be utilized for the upper and lower portions of the encasement sheet 40.

With the upper and lower wrapping bands 60 in position, the encasement sheet 40 and its associated parts which make up encasement E will be firmly retained upon the portion of the structural element M to be protected. The upper and lower wrapping bands 60 will serve to compress the seal bands 54 and 56 between the upper and lower portions of the encasement sheet 40 and the upper and lower portions of back-up cylinder 34. Since the interior surfaces of the filler blocks 26 are sealingly engaged with the structural element M, and the vertical edges of the encasement sheet 40 are sealed by their interaction with the rolled-up pole pieces 46 and 48, the portion of such structural element covered by the encasement E will be effectively sealed against contact with both sea water and air. Corrosion from these elements will thereby be effectively prevented.

It is important to note that the back-up sheet 34 covers the sharp edges of structural element M so as to prevent abrasive damage to encasement sheet 40, particularly where such edges are corroded. Hence, it is not necessary to remove such corrosion before the encasement sheet E is installed. The filler blocks serve both to support back-up sheeet 34 in its circular configuration, and also provide a uniform surface for effecting a seal.

With respect to the preceding description of the embodiment of the invention shown in FIGS. 1–7, it should be particularly noted that intermediate filler block assemblies (not shown) may be utilized for longer lengths of metallic structural elements M. Additionally, a plurality of vertically overlapping encasement modules may be employed where the portion of the structural element M to be protected is sufficiently long to make the use of such plurality of encasements preferable to the use of a single long encasement.

Referring now to FIGS. 9 through 14, there is shown a second form of encasement apparatus E′ embodying the present invention. The encasement E′ is utilized with an H-shaped metallic structural element M, such as the steel piling shown in the preceding Figures. The second form of water and airtight encasement E′ is applied to a submerged portion of structural element M and the splash zone portion of such structural element immediately above the submerged portion, the water level being indicated at 20.

This form of invention utilizes top and bottom filler block assemblies 70 and 72. Each filler block assembly comprises two like pairs of generally rectangular blocks molded from the materials described hereinbefore in connection with filler blocks 26 and 28. The structural element-abutting edge surfaces of such filler blocks may receive a coating of a suitable water and airtight adhesive designated 65 to permit such blocks to be manually affixed in place to the partially submerged structural element M. The filler blocks 70 and 72 will be seen to fill the opposing cavities 28 of structural element M so as to provide such structural element with a uniform horizontal cross section. Note that in FIG. 10 the lower filler blocks 72 have been adhered to element M.

The sides of the structural element M defining cavities 28 receive a like pair of back-up channels 80. Such back-up channel are disclosed particularly in FIG. 9. The channels 80 may be of a thermo-formed polyvinyl chloride and will preferably be rigid. As indicated in FIG. 11, such back-up channels 80 fit over the opposing sides of the structural member M. With further reference to this Figure, before the back-up channels 80 are applied, under and lower interior foam sealing bands 82 and 84 will be wrapped around the structural element so as to overlie the upper and lower filler block assemblies 70 and 72. These sealing bands will be similar to the sealing bands 54 described hereinbefore. The back-up channels 80 may be affixed to the structural element M by suitable fastening means (not shown).

Referring now to FIG. 12, a substantially rectanguar sheet of synthetic plastic material similar to the encasement sheet 40 described hereinbefore will be wrapped around the structural element M and the back-up channels 80. Thereafter, the vertical edges of such sheet will be joined together by pole pieces 46 and 48 in the same manner described hereinbefore with respect to the embodiment shown in FIGS. 1–8. It will be noted that exterior upper and lower sealing bands 86 similar to sealing bands 56 described hereinbefore will be interposed between the upper and lower portions of the encasement sheet 40 and the upper and lower portions of the back-up channels 80. Thereafter, as indicated in FIG. 12, a pair of upper and lower wrapping bands 60 similar to the wrapping bands 60 described hereinbefore will be secured around the upper and lower portions of the encasement sheet E so as to effect an water and airtight seal between such encasement sheet, the back-up channels 80 and the structural element M. The vertical edges of the encasement sheet are sealed by their interaction with the rolled-up pole pieces 46 and 48. Accordingly, the portion of the structural element M covered by the encasement E′ will be effectively sealed against contact with both sea water and air. Corrosion by these elements will thereby be effectively prevented. It will be noted that the back-up channels 80 in this embodiment of the invention will cover the sharp edges of structural element M in the same manner as the back-up sheet 34 covered the edges of the structural element M shown in FIGS. 1–7.

Referring now to FIG. 14, there is shown an arrangement utilizing a pair of abutting upper and lower encasements E′1 and E′2. As indicated hereinbefore, this arrangement may be employed where the length of the portion of the structural element M to be protected is sufficiently long as to make it more convenient to utilize a plurality of barrier encasements rather than a single long barrier encasement.

It should be noted that although an H-shaped vertical metallic piling has been disclosed hereinbefore, metallic structures of other cross-sections may be protected by encasements embodying the present invention. By way of example, protection may be afforded angle irons, I-beams and the like, not only when such elements are arranged vertically, but also when arranged horizontally or diagonally.

Various modifications and changes may be made with respect to the foregoing detailed description without departing from the spirit of the invention.

I claim:

1. Apparatus for protectively encasing an installed metallic columnar structural element of irregular horizontal cross-section against corrosion from water, air or a combination of water and air, comprising:

top and bottom filler block assemblies secured to vertically spaced portions of said structural element to fill the cavities thereof;

a split cylindrical back-up sheet means encircling said structural element in abutment with the exterior surface of said filler block assemblies and covering the edges of said elements, said back-up sheet means bring formulated so as to have a relaxed diameter less than the diameter defined by the outer diameter of said filler block assemblies;

a generally rectangular, synthetic plastic, pliable water and airtight encasement sheet of a length at least as great as the length of the portion of said structural element to be protected, said encasement sheet being wrapped about said back-up sheet means with its edges overlapping;

a pair of vertically extending, abutting pole pieces secured to the edges of said encasement sheet in a rolled-together water and airtight relationship with respect to the edges of said encasement sheet whereby said sheet is held against said back-up sheet means;

upper and lower sealing bands of compressible foam interposed between the outer edges of said filler block assemblies, the upper and lower ends of said back-up sheet means, and the upper and lower portions of said encasement sheet, with the upper and lower ends of said pole pieces terminating below and above said upper and lower sealing bands, respectively; and upper and lower wrapping bands extending around the upper and lower portions of said encasement sheet and said pole pieces to compress said sealing bands into a water and airtight sealing relationship with the upper and lower ends of said encasement sheet, the upper and lower ends of said back-up sheet means, and said filler block assemblies, said wrapping bands also retaining said encasement sheet and said pole pieces firmly upon said structural element, with said sealing bands and rolled-together pole pieces cooperating with said encasement sheet, said back-up sheet means and said filler block assemblies to prevent the entry of air and water into the space between said sheet and the portion of said structural element to be protected.

2. Apparatus as set forth in claim 1, wherein:

foam strip means are interposed between said pole pieces.

* * * * *